US011428031B2

(12) United States Patent
Rosales

(10) Patent No.: US 11,428,031 B2
(45) Date of Patent: Aug. 30, 2022

(54) MOTOR VEHICLE LOCK

(71) Applicant: Brose Schliesssysteme GmbH & Co. Kommanditgesellschaft, Wuppertal, Wuppertal (DE)

(72) Inventor: David Rosales, Rochester Hills, MI (US)

(73) Assignee: Brose Schliesssysteme GmbH & Co. Kommanditgesellschaft, Wuppertal, Wuppertal (DE)

( * ) Notice: Subject to any disclaimer, the term of this patent is extended or adjusted under 35 U.S.C. 154(b) by 379 days.

(21) Appl. No.: 16/414,192

(22) Filed: May 16, 2019

(65) Prior Publication Data

US 2020/0362600 A1 Nov. 19, 2020

(51) Int. Cl.

*E05B 81/20* (2014.01)
*E05B 79/20* (2014.01)
*E05B 81/16* (2014.01)

(52) U.S. Cl.

CPC ..... *E05B 81/20* (2013.01); *E05B 79/20* (2013.01); *E05B 81/16* (2013.01)

(58) Field of Classification Search

CPC ..... E05B 81/20; E05B 81/16; E05B 81/14; E05B 81/15; E05B 81/18; E05B 85/24; E05B 85/243; E05B 85/26; E05B 79/20; Y10T 292/1082; Y10T 292/1047; Y10S 292/23

See application file for complete search history.

(56) References Cited

U.S. PATENT DOCUMENTS 6,471,259 B1 10/2002 Weyerstall et al.
7,614,670 B2 * 11/2009 Hayakawa ..... E05B 81/20 292/201
2002/0070564 A1 * 6/2002 Ohta ..... E05B 81/20 292/201

FOREIGN PATENT DOCUMENTS

DE 19700887 A1 * 7/1998 ..... E05B 81/20
DE 102017118603 A1 * 2/2019 ..... E05B 81/20
FR 2768761 A1 * 3/1999 ..... E05B 81/20

OTHER PUBLICATIONS

Computer Generated Translation for DE 19700887, Generated on Jun. 10, 2021, https://worldwide.espacenet.com/ (Year: 2021).*

* cited by examiner

*Primary Examiner* — Alyson M Merlino
(74) *Attorney, Agent, or Firm* — Brooks Kushman P.C.

(57) ABSTRACT

A motor vehicle lock including a catch, a pawl, and a drivetrain arrangement with a drive element. When the catch is in the secondary closed position, the pawl is moveable from the engaged state the released state to release the catch. The drive element may be configured to move in a predefined drive direction. The motor vehicle lock may include a first coupling element, provided with a first coupling surface and a second coupling element, provided with a second coupling surface. During the cinching sequence, the first coupling surface and the second coupling surface may be engaged with one another to move the catch. During the release sequence the drive element is moved in the predefined drive direction such that the first coupling surface and the second coupling surface are disengaged from one another.

19 Claims, 4 Drawing Sheets

MOTOR VEHICLE LOCK

TECHNICAL FIELD

The present disclosure relates to a motor vehicle lock and a motorized drive.

BACKGROUND

Vehicles may include one or more closures, such as, hatches, doors, tailgates, or liftgates. Certain closures may close and open automatically, e.g. without the assistance of an operator. Vehicles generally include a seal or other type of weather proofing barrier positioned between the closure and the vehicle body to mitigate external elements such as moisture, precipitation, dirt, debris, and noise from entering the interior of the vehicle. The force applied to the closure, by a latch for example, must be sufficient to overcome pressure associated with the closure and the seal. Also, the vehicle may be equipped with a device or mechanism that may automatically release the latch, so the closure may move to an open position.

SUMMARY

The present disclosure may provide a motor vehicle lock configured to perform a cinching function and an opening function, and include a simple overall structure.

According to one embodiment, a motor vehicle lock that may include a detent mechanism provided with a catch, a pawl, and a drivetrain arrangement provided with a drive element, is provided. The drive element may be driven to perform the opening function and the cinching function. The motor vehicle lock may perform a cinching sequence to perform the cinching function. The motor vehicle lock may perform a release sequence, to perform the opening function. In the cinching sequence, the catch may be driven into a primary closed position. In the release sequence, the pawl may be being driven to a release state.

Both above noted functions may be realized by driving the single drive element in one and the same, predefined drive direction.

The idea underlying the disclosure is now to use the drive element, in particular a drive movement of the drive element in the predefined drive direction, to bring the drivetrain arrangement into a decoupling state, when the pawl is to be released.

In detail, it is proposed that the drivetrain arrangement may include a first coupling element with a first coupling surface and a second coupling element with a second coupling surface, that during the cinching sequence, the first coupling surface and the second coupling surface are in driving engagement with each other, transferring drive movements from the drive element to the catch and that in the release sequence, by driving the drive element in the predefined drive direction, the drivetrain arrangement enters a decoupling state, in which the first coupling surface and the second coupling surface are out of driving engagement from each other.

According to one or more proposed solutions contemplated by this disclosure, the opening function as well as the cinching function may be realized with one and the same drive element, which is only to be driven in one and the same, predefined drive direction. This means, that the drive element may well be driven via a drive cable such as a bowden cable. This also means that the drive motor, that provides the motorized movement of the drive element, does only need to provide the drive motion in one single direction. This leads to a cost effective and an especially compact mechanical arrangement. Also in view of electrical control, the proposed solution is particularly simple, as the motorized movements have to be generated only in one single direction by the respective motorized drive.

The expression "decoupling state" is to be understood in a wide sense. This means, that for the decoupling state it is only necessary that the first coupling surface and the second coupling surface are out of driving engagement from each other. At the same time, it may be realized, that a gearing state is established, that "replaces" the above noted coupling state, as will be explained later. Accordingly, the way of interaction between the two coupling elements is varied during the release sequence, such that the drive element may drive the pawl into its release state without being unduly hindered by a possible interaction between the catch and the drivetrain arrangement.

Synchronization between the pawl entering its release state and the drivetrain arrangement entering its decoupling state may be provided. In this respect, the proposed solutions offer constructional flexibility.

The pawl may be released from the holding force of the catch, while or before the pawl is raised into its released position. This may provide low driving forces needed to raise the pawl.

The cinching sequence the drive element being reversed and the release sequence going back on a release drive movement of the drive element. Those drive movements may be separate from each other in view of the respective position of the drive element, which allows a particularly simple constructional arrangement.

The drive element may be coupled to the catch on the one hand and to the pawl on the other hand via two drivetrains, which are at least partly different from each other. Again, this allows to realize the motor vehicle lock with a simple construction.

A catch drivetrain, namely the drivetrain between the drive element and the catch, may include a catch engagement lever.

According to another embodiment of the present disclosure, the drivetrain arrangement may enter the decoupling state goes as the drivetrain arrangement enters a gearing state. In the gearing state, two coupling elements may interact with each other via a first gearing surface and a second gearing surface. This may be advantageous, because during the release sequence, the gearing state may allow the catch to back-drive the drive element into the direction of its initial position, after the pawl has entered its release state.

According to another embodiment, the drive element and the catch engagement element may each provide one of the coupling elements, which allows for a particular compact mechanical construction.

One or more embodiments may provide particularly simple solutions to realize the decoupling state of the drivetrain arrangement. For example, the coupling elements may move relative to each other such that the coupling surfaces disengage from each other. The drive element may be pivotable about a drive element axis and the catch engagement lever may be pivotable about a catch engagement lever axis. The catch engagement lever axis and the drive element axis may be offset from each other such that, during the release sequence, the coupling surfaces disengage from each other.

Back-driving of the drive element by the catch may be provided the the gearing state as noted above, that may provide a reset movement of the drive element into the direction of its initial position.

The pawl drivetrain may include a pawl engagement lever, that may engage the pawl during the release sequence.

According to yet another embodiment, a motor vehicle lock arrangement with a motor vehicle lock as noted above and with a motorized drive, is provided. The motorized drive may be coupled to the drive element of the drivetrain arrangement of the motor vehicle lock and may provide a motorized cinching sequence and a motorized release sequence as noted above. All explanations given with respect to embodiments previously described are fully applicable to this second teaching.

The motorized drive may be arranged separately from the motor vehicle lock, which allows a modular arrangement of the motor vehicle lock arrangement. However, in one or more embodiments, the motorized drive may be integrated to the motor vehicle lock, provide a very compact arrangement.

BRIEF DESCRIPTION OF THE DRAWINGS

In the following, an embodiment of the invention is explained with respect to the drawings. In the drawings show FIG. 1 a motor vehicle with a proposed motor vehicle lock, FIG. 2 the motor vehicle lock according to FIG. 1 during the cinching sequence with the catch a) in the secondary closed position and b) in the overtravel position, FIG. 3 the motor vehicle lock according to FIG. 1 during the release sequence with the catch a) in its primary closed position and b) in its switching position and FIG. 4 the motor vehicle lock according to FIG. 1 at the end of the release sequence with all components of the motor vehicle lock having returned to their respective initial positions.

The proposed motor vehicle lock 1 may be assigned to any kind of closing element of a motor vehicle, insofar as reference is made to the introductory part of the specification.

DETAILED DESCRIPTION

Figure 1:
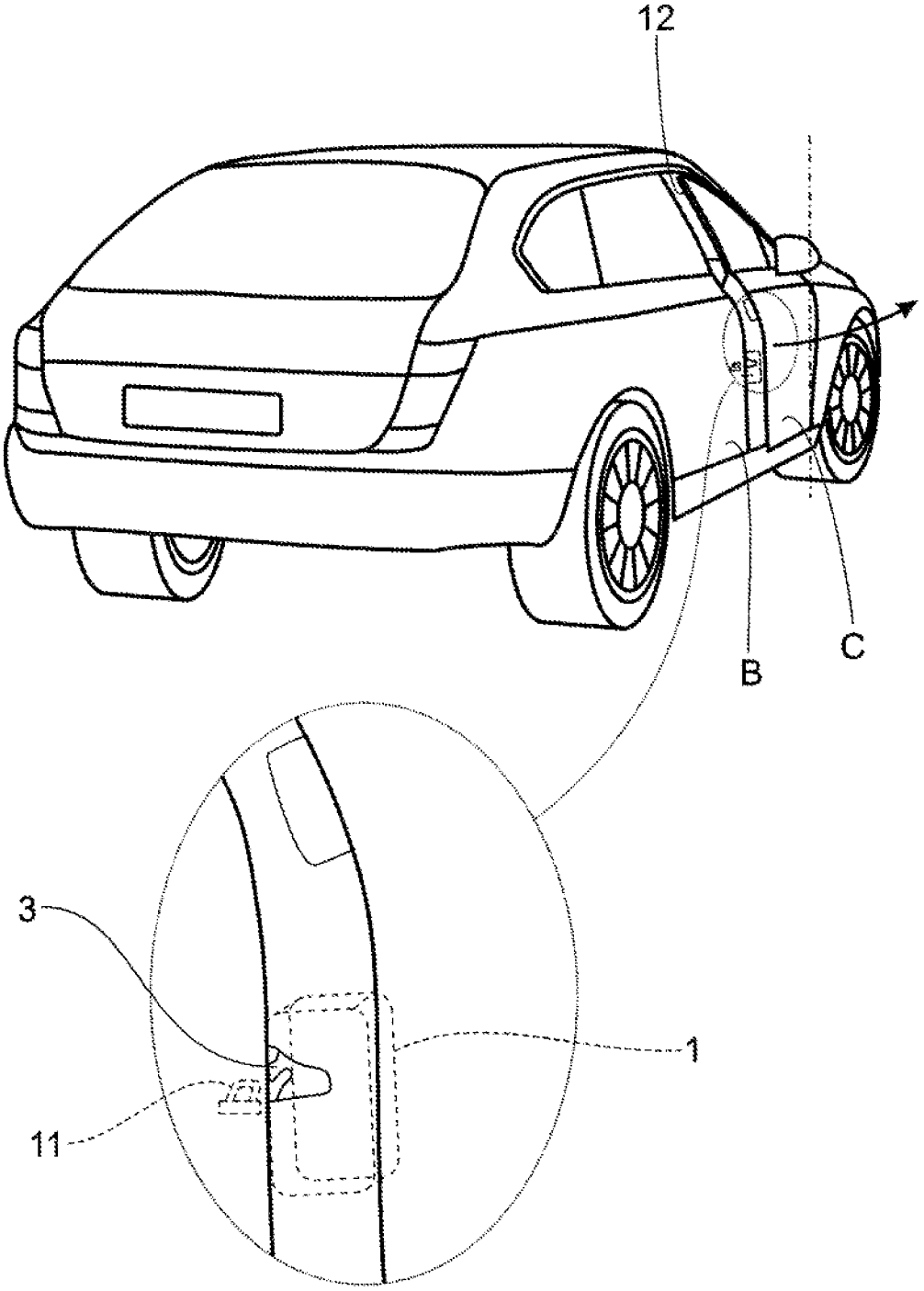

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The motor vehicle lock in question may be associated with any kind of closing element of a motor vehicle. Such a closing element of a motor vehicle may be a liftgate, a trunk lid, a back door, a front hood, a side door or the like. All those closing elements may be designed as pivotable or slidable closing elements.

The motor vehicle lock in question may perform one or more motorized functions to increase the user-friendliness of the motor vehicle. One of the functions may be motorized opening of the motor vehicle lock, such that the manual force needed to open the motor vehicle lock is low, regardless of environmental conditions such as temperature, humidity, age of the motor vehicle or the like. The other function may be a so-called "cinching-function", which provides a motorized closing movement of the associated closing element before reaching a fully closed position. This increases the user-friendliness, as this last section of the closing movement is against forces generated by compressing seals between the body and the closing element.

One example of a motor vehicle lock is disclosed in U.S. Pat. No. 6,471,259 B1 and includes a detent mechanism with a catch and a pawl, which interact with each other in order to hold the closing element in its respective closed position. For this, the catch may be pivoted between an open position, a primary closed position and a secondary closed position. For the opening function, a motorized opening drive is provided. For the cinching function, a motorized cinching drive is provided. Although in case of an emergency, the cinching drive is used for the cinching-function as well as for the opening-function, the opening drive is necessary in any case for moving cinching-drive out of the path of movement of the catch.

The motor vehicle lock 1 may include a detent mechanism 2 with a catch 3 and a pawl 4, which interact with each other in the usual way, as will be explained.

The motor vehicle lock 1 may include a drivetrain arrangement 5 with a drive element 6. The drivetrain arrangement 5 is designed to transmit drive movements from the drive element 6 to the detent mechanism 2. For this, motorized drive movements may be introduced into the drive element 6, as will be explained as well.

The catch 3 may be pivoted around a catch axis 3*a* between an open position (FIG. 4), a primary closed position (FIG. 3*a*) and a secondary closed position (FIG. 2*a*), which secondary closed position is situated between the open position and the primary closed position. The pawl 4 may be brought into an engaged state, blocking the catch 3 in the primary closed position (FIG. 3*a*) and in the secondary closed position (FIG. 2*a*) and may be raised into a release state (FIG. 3*b*) to release the catch 3. For this, the pawl 4 is pivotable around a pawl axis 4*a*.

A predefined drive direction 7 is assigned to the drive element 6. In the drawings, this predefined drive direction 7 is the clockwise direction. The drive element 6 may also be moved in a reverse direction 8, which is opposite to the drive direction 7. The drive element 6 is pivotable around a drive element axis 6*a*.

Figure 2:
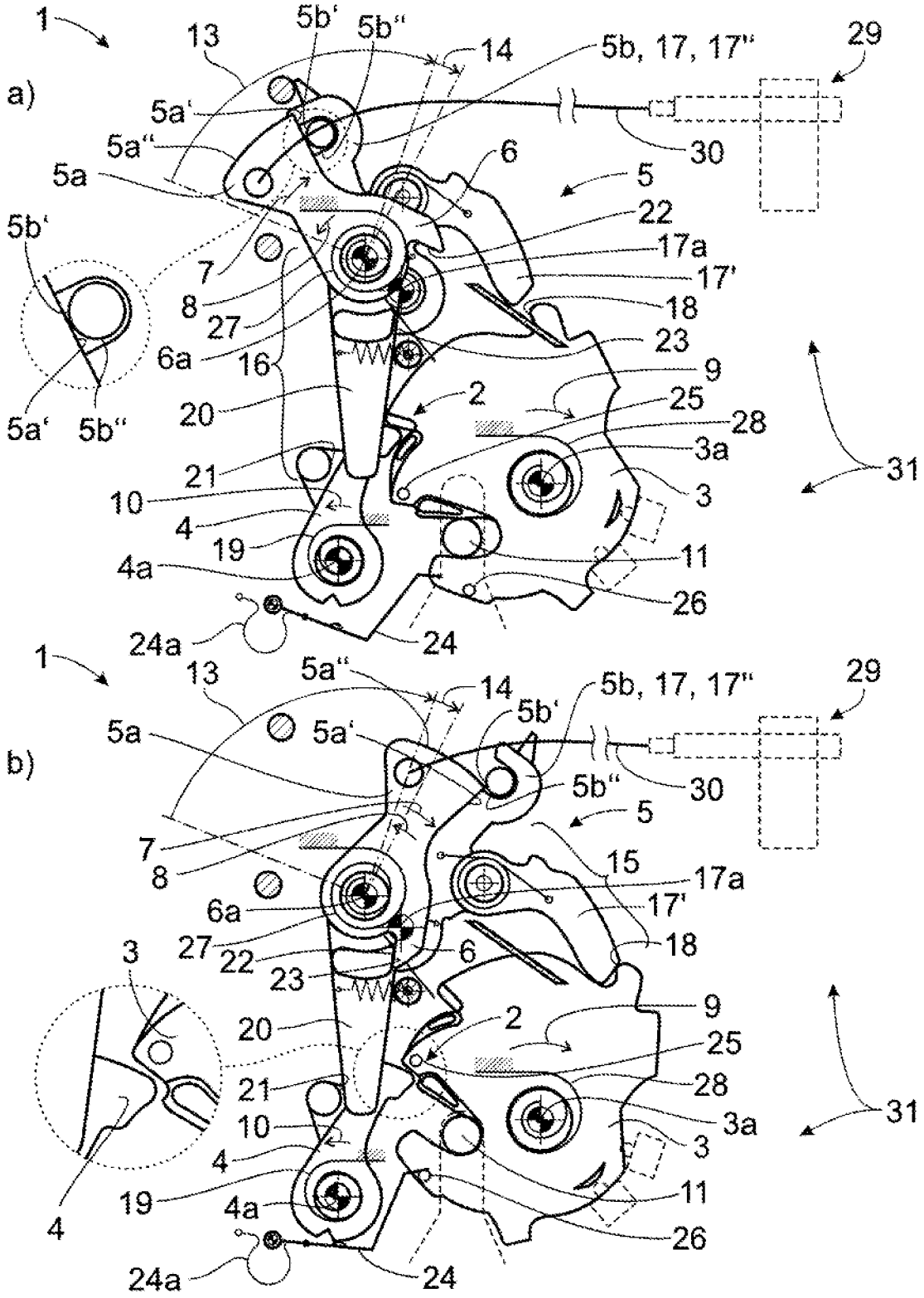

The sequence of FIG. 2*a*, 2*b* represents the cinching sequence, which is caused by driving the drive element 6 in the predefined drive direction 7. In the cinching sequence, the drivetrain arrangement 5 enters into engagement with the catch 3 and drives the catch 3 in its closing direction 9 into its primary closed position, and possibly to an overtravel position beyond the primary closed position as shown in FIG. 2*b*. During the cinching sequence, the initial position of the catch 3 may be the secondary closed position, while the final position of the catch 3 may be the primary closed position.

Figure 3:
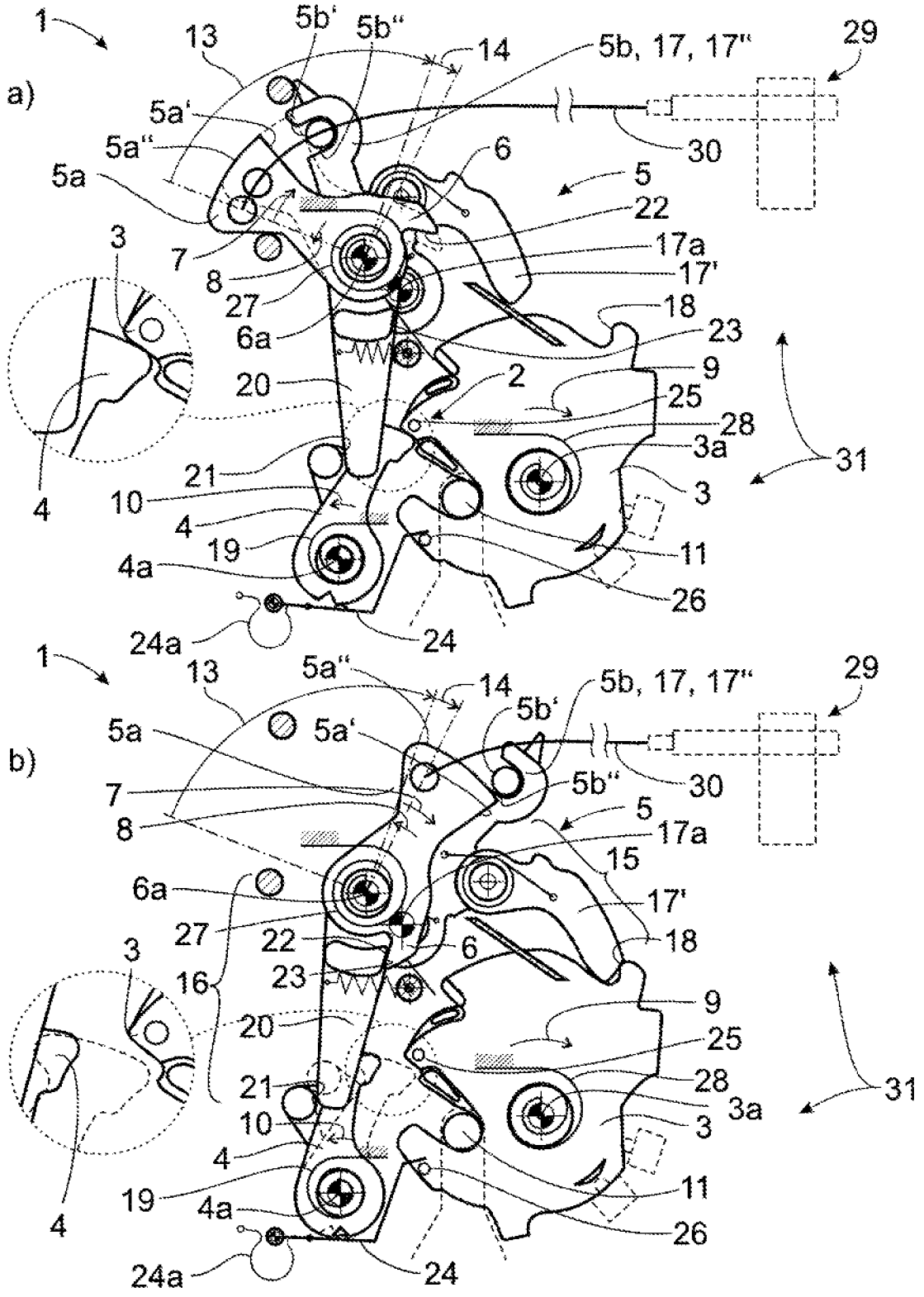
Figure 4:
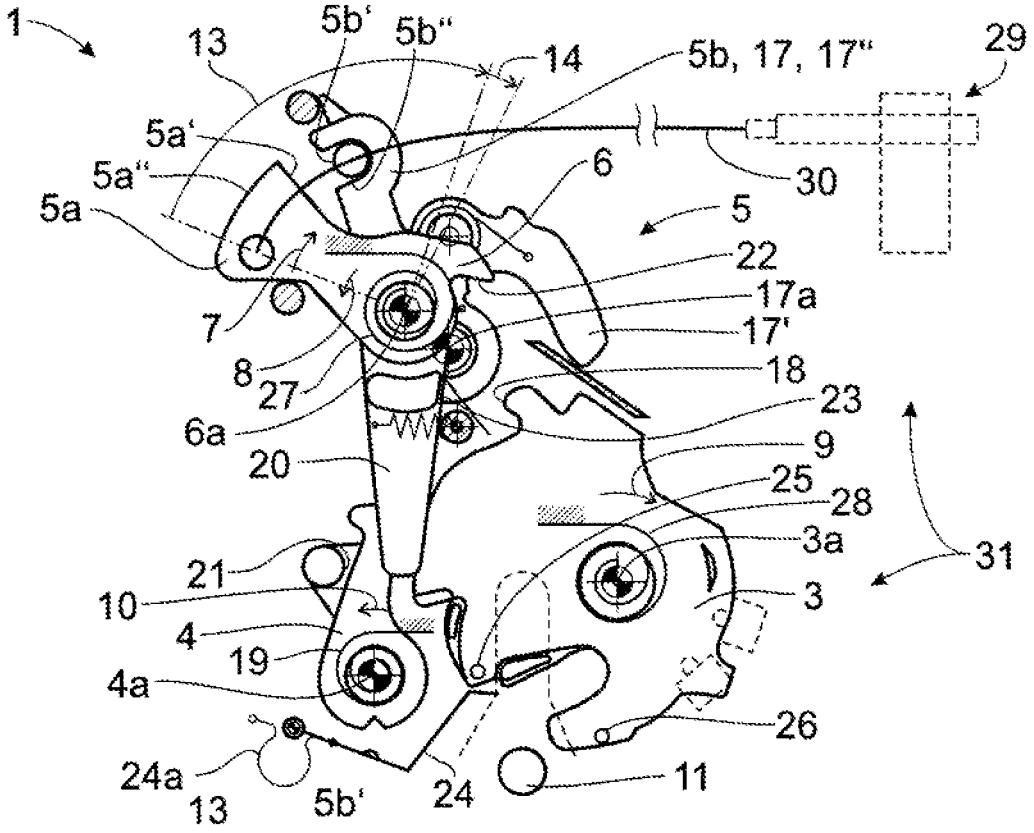

The sequence of FIG. 3*a*, 3*b*, 4 represents a release sequence, which is caused by driving the drive element 6 in the predefined drive direction 7 as well. During the release sequence, the drivetrain arrangement 5 enters into engagement with the pawl 4 and drives the pawl 4 in its released direction 10 into its release state (FIG. 3*b*).

In one or more embodiments, during the release sequence, again by driving the drive element 6 in the predefined drive direction 7, the drivetrain arrangement 5 enters a decoupling state (FIG. 3*b*). For this, the drivetrain arrangement 5 may include a first coupling element 5*a* with a first coupling surface 5*a*' and a second coupling element 5*b* with a second coupling surface 5*b*'. During the cinching sequence, the first coupling surface 5*a*' and the second coupling surface 5*b*' are in driving engagement with each other, transferring drive movements from the drive element 6 to the catch 3, as may be extracted from the sequence of FIG. 2*a*, 2*b*.

In one or more embodiments, the release sequence, by driving the drive element 6 in the predefined drive direction 7, the drivetrain arrangement 5 enters a decoupling state, in which the first coupling surface 5*a*' and the second coupling surface 5*b*' are out of driving engagement from each other, as may be seen in FIG. 3*b*. With the decoupling state of the drivetrain arrangement 5 being caused by driving the drive element 6 in the predefined drive direction 7, the cinching sequence as well as the release sequence may be realized by introducing motorized movements into the drive element 6 in only one drive direction, which makes the resulting mechanical construction particularly simple.

Just as a matter of completeness, it may be pointed out, that the catch 3 in its closed position is in holding engagement with a lock striker 11. The motor vehicle lock 1 may be arranged at a closing element C, while the lock striker 11 may arranged at the body B of the motor vehicle. A vice versa arrangement is possible.

One interesting aspect of the shown embodiment is that during the release sequence, the pawl 4 enters its release state just before the drivetrain arrangement 5 enters its decoupling state. This is indicated in FIG. 3*b*. The resulting effect is that the pawl 4 may be released from the catch 3 while the catch 3 is still held by the drive element 6 in a position beyond the open position, such that releasing the pawl 4 requires low driving forces.

The above is especially true, when, during the release sequence, by driving the drive element 6 in the predefined drive direction 7, the drivetrain arrangement 5 enters into engagement with the catch 3 and moves the catch 3 in its closing direction into an overtravel position beyond the primary closed position, while or before the pawl enters its release state. This corresponds to the sequence of FIG. 3*a*, 3*b*. However, it may well be realized, that during the release sequence, the pawl 4 enters its release state after the drivetrain arrangement 5 enters its decoupling state.

The cinching sequence goes back on a cinching drive movement 13 of the drive element 6, while the release sequence goes back on a release drive movement 14 of the drive element 6. This is indicated in the drawings. Here it becomes apparent, that the cinching drive movement 13 and the release drive movement 14 are adjoining each other with respect to the position of the drive element 6. However, the drive element 6, before starting the release sequence, may be reversed into its initial position as shown in FIG. 3*a*.

A comparison of FIG. 2*b* and FIG. 3*b* shows that the drivetrain arrangement 5 may include a catch drivetrain 15 between the drive element 6 and the catch 3 and a pawl drivetrain 16 between the drive element 6 and the pawl 4, wherein the catch drivetrain 15 and the pawl drivetrain 16 are at least partly different from each other. The two coupling elements 5*a*, 5*b* of the drivetrain arrangement 5 may be part of the catch drivetrain 15.

Various constructional embodiments for the realization of the proposed solution are possible. In the embodiment shown in the drawings, the catch drivetrain 15 may include a catch engagement lever 17, which, during the cinching sequence, is driven to enter into engagement with an engagement surface 18 of the catch 3, thereby driving the catch 3 into its primary closed position and, here and possibly to the overtravel position beyond the primary closed position. The catch drivetrain 15 may include the drive element 6 as well as the catch engagement lever 17, which catch engagement lever 17 is pivotably coupled to the drive element 6 at a catch engagement lever axis 17*a*. When the drive element 6 is driven in its predefined drive direction 7 starting from the situation shown in FIG. 2*a*, the catch engagement lever 17 enters into engagement with the engagement surface 18 of the catch 3, thereby driving the catch 3, and possibly from the secondary closed position, into its primary closed position. In order to allow the pawl 4 to fall into its engagement state due to the force of the pawl spring 19, the catch engagement lever 17 may drive the catch 3 into the overtravel position beyond the primary closed position. This is shown in FIG. 2*b*.

In one or more embodiments, it is provided, that the catch engagement lever 17 may include an output lever 17', which, during the cinching sequence, enters into engagement with the engagement surface 18 of the catch 3 (FIG. 2*b*). The catch engagement lever 17 may include an input lever 17", which is pivotable around the catch engagement lever axis 17*a* and which, together with the output lever 17', establishes a knee lever mechanism. The result is a high cinching momentum at the catch 3 without the need for high driving forces. The catch engagement lever 17 may be a two piece component with a joint between the output lever 17' and the input lever 17", as noted above.

The decoupling state may well be a state in which there is no interaction between the two coupling elements 5*a*, 5*b* at all. However, in the decoupling state, an interaction between the coupling elements 5*a*, 5*b* may be in the form of a gearing. Accordingly, it is provided, that the first coupling element 5*a* may include a first gearing surface 5*a*" and that the second coupling element 5*b* may include a second gearing surface 5*b*", which gearing surfaces 5*a*", 5*b*", in the decoupling state, are engaged to establish a gearing between the coupling elements 5*a*, 5*b*. As will be noted below, in the decoupling state, those gearing surfaces 5*a*", 5*b*" lead to the drive element 6 being backdriveable by the catch engagement lever 17.

The coupling elements 5*a*, 5*b* may be provided by any drive component of the drivetrain arrangement 5. The drive element 6 may include the first coupling element 5*a* with the first coupling surface 5*a*', while the catch engagement lever 17, may include the input lever 17" of the catch engagement lever 17, provided with the second coupling element 5*b* that may be provided with the second coupling surface 5*b*".

During the release sequence, which is represented by the sequence of FIG. 3*a*, 3*b*, 4, the coupling elements 5*a*, 5*b* are being moved relative to each other such that the coupling surfaces 5*a*', 5*b*' come out of engagement from each other. In particular this becomes apparent from the dotted representation of the drive element 6 in FIG. 3*a* compared to the solid line representation of the drive element 6 in FIG. 3*b*.

The drive element 6 is pivotable around a drive element axis 6*a*, while the catch engagement lever 17 is pivotable around a catch engagement lever axis 17*a*. The drive element axis 6*a* and the catch engagement lever axis 17*a* are offset from each other such that, during the release sequence, due to the offset arrangement of the drive element axis 6*a* from the catch engagement lever axis 17*a*, the coupling surfaces 5*a*', 5*b*' come out of engagement from each other. This is shown by the sequence of FIG. 3*a* (drive element 6 in dotted line) and FIG. 3*b*. It is clear that the decoupling state is particularly simple to realize in one or more embodiments, just by arranging the drive element axis 6*a* and the catch engagement lever axis 17*a* in an offset fashion as noted above.

In the decoupling state, backdriving the catch engagement lever 17 here and may lead to backdriving the drive element 6 against its predefined drive direction 7. Further preferably, this backdriving may go back on the catch 3 acting on the output lever 17'.

With the drivetrain arrangement 5 entering its decoupling state while or before the pawl 4 entering its release state, it is generally possible for the pawl 4 to be raised into its release state, when the catch 3 is beyond its primary closed position. This allows for the pawl 4 to be raised with a low driving force. The pawl 4 may be driven into its release state when catch 3 is in its overtravel position noted above.

FIG. 3*b* shows, that the pawl drivetrain 16 may include a pawl engagement lever 20, that, during the release sequence shown in FIG. 3*a*, 3*b*, 4, is driven to come into engagement with an engagement surface 21 of the pawl 4, driving the pawl 4 into its release state as shown in FIG. 3*b*.

The release sequence shown in FIG. 3*a*, 3*b*, 4 is working as follows: starting from the catch 3 being in its primary closed position, the drive element 6 is being driven in its predefined drive direction 7, in FIG. 3 in the clockwise direction.

Driving the drive element 6 in its predefined direction 7 leads to the coupling surface 5*a'* to come into engagement with the coupling surface 5*b'*, moving the catch engagement lever 17 via the input lever 17" and the output lever 17' into engagement with the engagement surface 18 of the catch 3. This results in a movement of the catch 3 into a switching position, which is beyond the closing position of the catch 3 as shown in FIG. 3*b*. As soon as the catch 3 reaches its switching position, the drivetrain arrangement 5 enters its decoupling state, as shown in FIG. 3*b* as well. While or after the catch 3 reaches its switching position, the drive element 6 with its driving surface 22 enters into engagement with the driving surface 23 of the pawl engagement lever 20, driving the pawl engagement lever 20 into engagement with the engagement surface 21 of the pawl 4. This driving of the pawl engagement lever 20 into engagement with the engagement surface 21 of the pawl 4 causes the pawl 4 to be driven into its release state, as also shown in FIG. 3*b*.

After the pawl 4 has been driven into its release state, the catch 3, driven by the seal 12 of the closing element C, back drives the catch engagement lever 17, here and the output lever 17', such that the input lever 17" with its gearing surface 5*b"* comes into engagement with the gearing surface 5*a"* of the drive element 6 and back drives the drive element 6 in the direction of its initial position shown in FIG. 4. Here it is to be understood, that the drawings do not provide exact constructional information. This is especially true with regard to the design of the gearing surfaces 5*a"* and 5*b"*.

In order to prevent the pawl 4 from falling back into the primary closing position or the secondary closing position during back driving of the drive element 6, a memory element 24 with a toggle spring 24*a* is provided. The memory element 24 may be in a deactivated state, as shown in FIG. 4, and in an activated state, as shown in FIG. 3. Due to the toggle spring 24*a*, the memory element stably holds it respective state.

During the cinching sequence, the memory element 24 enters into engagement with an activation element 26, driving the memory element 24 into its activated state. This corresponds to the sequence of FIG. 2*a*, 2*b*.

During the release sequence, the memory element 24 is in the activated state, coming into a form fit engagement with the pawl 4, when the pawl 4 enters its release state, as shown in FIG. 3*b*. Due to the stable state of the memory element 24, the pawl 4 is held in the release state. When the catch 3 reaches its open position shown in FIG. 4, the deactivation element 25 comes into engagement with the memory element 24, driving the memory element 24 into the deactivated state, releasing the pawl 4.

In one or more embodiments, a motorized drive 29 is provided. The motorized drive 29 may be coupled to the drive element 6 of the drivetrain arrangement 5 in order to provide a motorized cinching sequence and a motorized release sequence as noted above. Such motorized drive 29 is indicated in the drawings. The motorized drive 29 may be an integral part of the motor vehicle lock 1, leading to a compact overall arrangement. However, the motorized drive 29 may be arranged separately from the motor vehicle lock 1. Further preferably, the motorized drive 29 is coupled to the drive element 6 via a drive cable, in particular, a bowden cable 30.

According to one or more embodiments, a motor vehicle lock arrangement 31 may include an above noted motor vehicle lock 1 as well as an above noted motorized drive 29. As one example, the motorized drive 29 may be coupled to the drive element 6 of the drivetrain arrangement 5 in order to provide a motorized cinching sequence and a motorized release sequence. All explanations given for the motor vehicle lock 1 and its interaction with the motorized drive 29 are fully applicable to this teaching.

The motorized drive 29 may be arranged separately from the motor vehicle lock 1 as noted above. Further, the coupling between the motorized drive 29 and the drive element 6 may include a drive cable and, such as an above noted bowden cable 30, which is indicated in the drawings by just a solid line.

According to one or more embodiments, the motorized drive 29 for a motor vehicle lock may be provided by a closing element drive (not shown), which serves for driving the closing element C between an opened position and a closed position of the closing element C. The closing element drive may be coupled to the closing element C on the one hand and to a drive cable, such as a bowden cable, on the other hand. The closing element drive may be assigned a mechanical linkage, which may be driven between a deployed state and a retracted state by the closing element drive, wherein the drive cable transmits a drive movement depending on its change in state.

A motor vehicle lock 1, such as a motor vehicle lock 1 described above, may be coupled to the drive cable. In the shown embodiment, the drive element 6 may be coupled to the drive cable, such that a cinching sequence and/or a release sequence may be initiated by the closing element drive. The motor vehicle lock 1 may be brought into an opening state, into a secondary closing state and into a primary closing state.

The closing element drive may include a drive motor, which may be driven in two drive directions, whereby the drive motor may be positioned into a number of drive positions.

In order to drive the motor vehicle lock 1 into its secondary closing state, in a first step, the drive motor is driven in its first drive direction into a first drive position, driving the closing element into a position, which corresponds to the secondary closing position of the motor vehicle lock 1. In a second step, the drive motor is again driven in its first drive direction into a second position, which leads to the mechanical linkage changing its state and thereby driving the motor vehicle lock 1 via the drive cable into its primary closed position. Finally, in a third step, the drive motor is driven in its second drive direction into a third drive position, which is arranged between the first drive position and the second drive position. Those three drive positions are stored in a motor controller and may be optimized during the operation of the proposed system. The drive positions may be represented by the respective number of rotations of a motor shaft or the like.

There are a number of advantageous constructional variants possible to realize the mechanical linkage. The linkage, for example, may comprise a sliding guide, being able to be slid between the above noted deployed and the above noted retracted state. The mechanical linkage may as well include a rotating cam, which rotation may lead to reaching the above noted deployed and the above noted retracted state.

It may finally be pointed out, that the above noted third teaching is not restricted to be used in connection with the above noted motor vehicle lock 1 according to the first teaching. It is rather universally applicable to all kinds of motor vehicle locks 1 that provide a cinching mechanism, which may be driven by a drive cable like a bowden cable.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A motor vehicle lock including a detent mechanism, provided with a catch and a pawl, the motor vehicle lock comprising:

a drivetrain arrangement provided with a drive element;

wherein the catch is configured to pivot between an open position, a primary closed position, and a secondary closed position, wherein when the catch is in the secondary closed position, the catch is positioned between the open position and the primary closed position, wherein when the pawl is in an engaged state, the pawl blocks the catch when the catch is in the primary closed position, wherein when the catch is in the primary closed position, the pawl is moveable to a release state to release the catch, wherein the drive element is configured to move in a predefined drive direction wherein in a cinching sequence, the drive element drives in the predefined drive direction, such that the drivetrain arrangement engages the catch to drive the catch in a closing direction into the primary closed position, wherein in a release sequence, the drive element moves in the predefined drive direction such that the drivetrain arrangement engages the pawl to drive the pawl in a release direction to the release state, wherein the drivetrain arrangement includes a first coupling element, provided with a first coupling surface, and a second coupling element, provided with a second coupling surface, wherein during the cinching sequence, the first coupling surface and the second coupling surface are in a driving engagement with each other such that drive movements are transferred from the drive element to the catch, wherein during the release sequence, the drive element is driven in the predefined drive direction such that the drivetrain arrangement is in a decoupling state, wherein when the drivetrain arrangement is in the decoupling state, the first coupling surface and the second coupling surface are in a disengaged driving engagement from each other, and wherein during the release sequence, the drive element is driven in the predefined drive direction, such that the drivetrain arrangement engages the catch to move the catch in the closing direction to an overtravel position while or before the pawl enters the release state, wherein the overtravel position is a position beyond the primary closed position.

2. The motor vehicle lock of claim 1, wherein during the release sequence, the pawl enters the release state before the drivetrain arrangement is in the decoupling state, or wherein during the release sequence, the pawl enters the release state after the drive train arrangement enters the decoupling state.

3. The motor vehicle lock of claim 1, wherein after the cinching sequence, the drive element moves in a reverse direction, opposite to the predefined drive direction.

4. The motor vehicle lock of claim 1, wherein the drivetrain arrangement includes a catch drivetrain, disposed between the drive element and the catch, and a pawl drivetrain disposed, between the drive element and the pawl, such that the catch drivetrain and the pawl drivetrain are at least partly different from each other.

5. The motor vehicle lock of claim 4, wherein the catch drivetrain includes a catch engagement lever, wherein during the cinching sequence, the catch engagement lever is driven to enter into engagement with an engagement surface of the catch, thereby driving the catch into the primary closed position.

6. The motor vehicle lock of claim 5, wherein the catch engagement lever includes an output lever, wherein during the cinching sequence, the output lever moves to engage the engagement surface of the catch, wherein the catch engagement lever includes an input lever, wherein the input lever is pivotable about a catch engagement lever axis, and wherein the input lever and the output lever form a knee lever mechanism.

7. The motor vehicle lock of claim 1, wherein in that the first coupling element includes a first surface and that the second coupling element includes a second surface, and wherein when the drivetrain arrangement is in the decoupling state, the first and second gearing surfaces are engaged.

8. The motor vehicle lock of claim 5, wherein the drive element includes the first coupling element provided with the first coupling surface and wherein the catch engagement lever includes the second coupling element provided with the second coupling surface.

9. The motor vehicle lock of claim 1, wherein during the release sequence, the coupling elements move relative to each other such that the first and second coupling surfaces disengage from each other.

10. The motor vehicle lock of claim 6, wherein the drive element is pivotable about a drive element axis and the catch engagement lever is pivotable about the catch engagement lever axis, and wherein the drive element axis and the catch engagement lever axis are offset from each other such that during the release sequence, the first and second coupling surfaces disengage from each other.

11. The motor vehicle lock of claim 6, wherein when the drivetrain arrangement is in the decoupling state, backdriving the catch engagement lever moves the drive element in a second predefined drive direction, wherein the second predefined drive direction is opposite the first predefined drive direction.

12. The motor vehicle lock of claim 1, wherein the drivetrain arrangement is provided with a pawl drivetrain including a pawl engagement lever, wherein during the release sequence, the pawl engagement lever is driven to engage an engagement surface of the pawl to drive the pawl to the release state.

13. The motor vehicle lock of claim 1, further comprising a motorized drive, wherein the motorized drive is coupled to the drive element of the drivetrain arrangement to provide the cinching sequence as a motorized cinching sequence and to provide the release sequence as a motorized release sequence.

14. The motor vehicle lock of claim 13, further comprising a cable, wherein the cable is operatively coupled to the motorized drive and the drive element.

15. A motor vehicle lock configured to operate in a cinching sequence and in a release sequence, the motor vehicle lock comprising:

a catch configured to pivot between an open position, a primary closed position, and a secondary closed position, wherein when the catch is in the secondary closed position, the catch is positioned between the open position and the primary closed position;

a pawl configured to move between an engaged state and a released state, wherein when the catch is in the primary closed position, the pawl is moveable from the engaged state to the released state to release the catch;

a drive element configured to move about a first axis in a predefined drive direction and including a first coupling surface; and a catch engagement lever configured to move about a second axis in the predefined drive direction and including a second coupling element provided with a second coupling surface, wherein during the cinching sequence, the first coupling surface and the second coupling surface are engaged with one another to move the catch to the primary closed position, wherein during the release sequence, the drive element is moved in the predefined drive direction such that the first coupling surface and the second coupling surface are disengaged from one another, and wherein during the release sequence, when the pawl is in the released state, the drive element is back driven against the predefined drive direction.

16. The motor vehicle lock of claim 15, wherein the first axis and the second axis are offset from one another.

17. The motor vehicle lock of claim 15, wherein the catch engagement lever includes an output lever, wherein during the cinching sequence, the output lever is configured to engage an engagement surface of the catch.

18. The motor vehicle lock of claim 17, wherein the catch engagement lever includes an input lever, wherein the input lever is pivotable about the second axis, and wherein the input lever and the output lever form a knee lever mechanism.

19. A motor vehicle lock configured to operate in a cinching sequence and in a release sequence, the motor vehicle lock comprising:

a catch configured to pivot between an open position, a primary closed position, and a secondary closed position, wherein when the catch is in the secondary closed position, the catch is positioned between the open position and the primary closed position;

a pawl configured to move between an engaged state and a released state, wherein when the catch is in the primary closed position, the pawl is moveable from the engaged state to the released state to release the catch;

a drive element configured to move about a first axis in a predefined drive direction and including a first coupling surface;

a catch engagement lever configured to move about a second axis in the predefined drive direction and including a second coupling element provided with a second coupling surface; and a pawl engagement lever configured to move about a third axis;

wherein during the cinching sequence, the first coupling surface and the second coupling surface are engaged with one another to move the catch to the primary closed position, wherein during the release sequence, the drive element is moved in the predefined drive direction such that the first coupling surface and the second coupling surface are disengaged from one another and wherein the pawl engagement lever engages and moves the pawl to the released state, and wherein during the release sequence, when the pawl is in the released state, the drive element is back driven against the predefined drive direction.

* * * * *